United States Patent [19]

Sandring

[11] 4,060,944

[45] Dec. 6, 1977

[54] MAINTENANCE PLATFORM FOR A BUILDING ROOF

[75] Inventor: Albert W. Sandring, Independence, Mo.

[73] Assignee: Butler Manufacturing Company, Kansas City, Mo.

[21] Appl. No.: 725,247

[22] Filed: Sept. 21, 1976

[51] Int. Cl.[2] ..... E04D 13/12

[52] U.S. Cl. ..... 52/43; 52/474; 182/45

[58] Field of Search ..... 52/43, 44, 474, 475, 52/127, 173, 476; 182/45

[56] References Cited

U.S. PATENT DOCUMENTS

| | | | |
|---|---|---|---|
| 655,941 | 8/1900 | Ross | 52/43 |
| 787,233 | 4/1905 | Tingleaf | 182/45 |
| 820,362 | 5/1906 | Link | 52/43 |
| 2,059,690 | 11/1936 | Gilpin | 52/42 |

FOREIGN PATENT DOCUMENTS

| | | | |
|---|---|---|---|
| 1,150,354 | 4/1969 | United Kingdom | 182/45 |

*Primary Examiner*—J. Karl Bell

*Attorney, Agent, or Firm*—Shoemaker and Mattare, Ltd.

[57] ABSTRACT

A maintenance platform for a building roof. The maintenance platform comprises a plurality of pre-formed panels, each seated on the roof panels of the roof and connected thereto by a non-penetrating clip. The maintenance platform can extend either longitudinally or transversely of the building ridge direction, or can be otherwise specially arranged.

18 Claims, 7 Drawing Figures

10
12
14
16
18
20
22
24
30
32
34
38
40
42
44
46
48
R
2
3

14
34''
50
62
130
38
136
134
60
34'
60'
62'

MAINTENANCE PLATFORM FOR A BUILDING ROOF

BACKGROUND OF THE INVENTION

The present invention relates to buildings, and more particularly, to building roofs.

Many buildings have equipment, skylights, and the like installed on the roof thereof. Often, such elements require servicing, in which case the panels forming the roof outer surface are required to support extra weight which results from new equipment, servicing equipment, or the service personnel themselves. Frequent foot traffic and heavy concentrated loads may damage the roof panels, reduce expected roof life, or even void any roof warranty in effect.

Increasing the strength of roof panels is one solution to the problem presented by the extra weight, but this solution may prove costly and uneconomical. Therefore, some means of protecting a building roof from the problems created by extra weight placed thereon by roof traffic is required.

Abrasion and subsequent deterioration of protective coatings on steel roof panels represents a primary problem with foot traffic on a roof. Such abrasion greatly reduces roof life by exposing the steel to rust. Scratches also represent a vexatious problem.

Roof maintenance platforms represent a convenient solution to this problem, yet, heretofore, there are no known maintenance platforms for building roofs. Roof maintenance platforms are, however, known in the railroad art, where roof running boards are provided on top of railroad cars. However, these running boards are generally permanently installed using bolts, rivets, penetrating fasteners, saddles, and the like. Furthermore, the roof of a railroad car is subject to different considerations than the roof of a building. One such consideration is the relative size of the two types of roofs. A weight to size ratio of a railroad car roof can be much greater than such a ratio for a building roof, as building roofs generally span much greater areas than railroad car roofs. Accordingly, any fasteners used with railroad car roof maintenance platforms are generally of the permanent and penetrating type, and such maintenance platforms are difficult and tedious to install. Once installed, the running boards cannot be moved to new locations.

The present invention provides a maintenance platform for a building roof which can support thereon roof traffic.

SUMMARY OF THE INVENTION

The roof maintenance platform embodying the teachings of the present invention will support roof traffic and can be quickly and easily installed on new or existing buildings.

The maintenance platform embodying the teachings of the present invention can be oriented either longitudinally or transversely of the building ridge direction. The maintenance platform comprises a plurality of preformed ribbed panels, each seated on flat tops of a ribbed roof to span the troughs of that roof. The roof panels are interconnected to each other by standing seams. The edgemost panel, or panels, of each maintenance platform has attached thereto a mesh closure for preventing debris, such as leaves or the like, from accumulating beneath the maintenance platform and thus interfering with proper roof drainage, and the like, as well as for preventing birds from nesting beneath the maintenance platform. The panels each have drain holes defined therein for draining rain, or melted snow, or the like from the maintenance platform.

Each maintenance platform is mounted on an associated roof panel by clips, each of which comprises a tab hooked into the roof panel standing seam and having a free end extending upwardly from and above the seam. A resilient clasp straddles the roof panel seam and has a tab receiving aperture defined therein, which receives the upper free end of the tab. The clasp is generally U-shaped and has outwardly extending wings attached to the legs thereof for engaging the top surfaces of the maintenance platform panels. With the clasp mounted onto the roof seam, the free end of the tab is bent over the clasp to prevent upward movement of that clasp with respect to the seam. The clip secures that panel to the roof panel.

Mastic is placed on the shoulders of the roof panel ribs adjacent the standing seam, and the edges of the maintenance platform panels are seated thereon. The roof panels are prepared by applying thereto a layer of roof coating prior to setting up the maintenance platform.

The maintenance platform is thus simply and easily installed on new or existing buildings using a screwdriver and a pair of pliers, and, once installed, will not be subject to rattling or other movement caused by wind gusts or the movement of personnel thereon. The maintenance platform of the present invention may also be easily removed and re-installed at a new location. The same maintenance platform panels can be used to form maintenance platforms directed either longitudinally of, or transversely of, the building ridge direction. Thus, the maintenance platform of the present invention is economical to install and to maintain.

As all of the fasteners are of the non-penetrating type, the maintenance platform panels are secured to a roof without penetrating that roof, and roof integrity is not disturbed by the installation of a maintenance platform.

Furthermore, the panels are all similarly shaped and can be overlapped to accommodate special maintenance platform shapes and dimensions such as L-shapes, T-shapes, cross-shapes, and the like. Being so shaped also allows the maintenance platform panels to be nestable for easy and convenient shipping and storage.

Preferably, all of the elements of the maintenance platform are manufactured of aluminum because of the desirable weatherability and longevity of that material. Special non-skid surfaces can also be used on the panels as well.

Preferably, the platform is used to support concentrated loads of not more than 300 pounds; however, it can be designed to support greater loads. However, in such cases, the maintenance platform panels and clips may have to be specially manufactured.

Each maintenance platform can be packaged and all of the materials sold as a kit. Because of the interchangeability of the maintenance platform panels, a single kit can be used for longitudinal or transverse maintenance platforms, as well as for the special maintenance platform configurations. For example, a single kit can include material sufficient to form a maintenance platform of 22 lineal feet in length; however, other dimensions can also be used. The kit can include not only the maintenance platform panels, clips and mesh fastening members, but the mastic and roof panel preparation as well, and may even include the mesh used to prevent debris from accumulating beneath the maintenance platform.

OBJECTS OF THE INVENTION

It is, therefore, a main object of the present invention to provide a building roof maintenance platform.

It is another object of the present invention to provide a building roof maintenance platform which is easily installed.

It is a further object of the present invention to provide a building roof maintenance platform which is easily relocated.

It is yet another object of the present invention to provide a building roof maintenance platform which is easily packaged and stored.

It is yet a further object of the present invention to provide a building roof maintenance platform which is easily adaptable to a variety of shapes and orientations on a building roof.

It is still a further object of the present invention to prevent abrasion and scratching of a protective coating placed on a roof.

These together with other objects and advantages which will become subsequently apparent reside in the details of construction and operation as more fully hereinafter. described and claimed, reference being had to the accompanying drawings forming part hereof, wherein like reference numerals refer to like parts throughout.

DETAILED DESCRIPTION OF THE PREFERRED EMBODIMENT

Figures 1, 7:
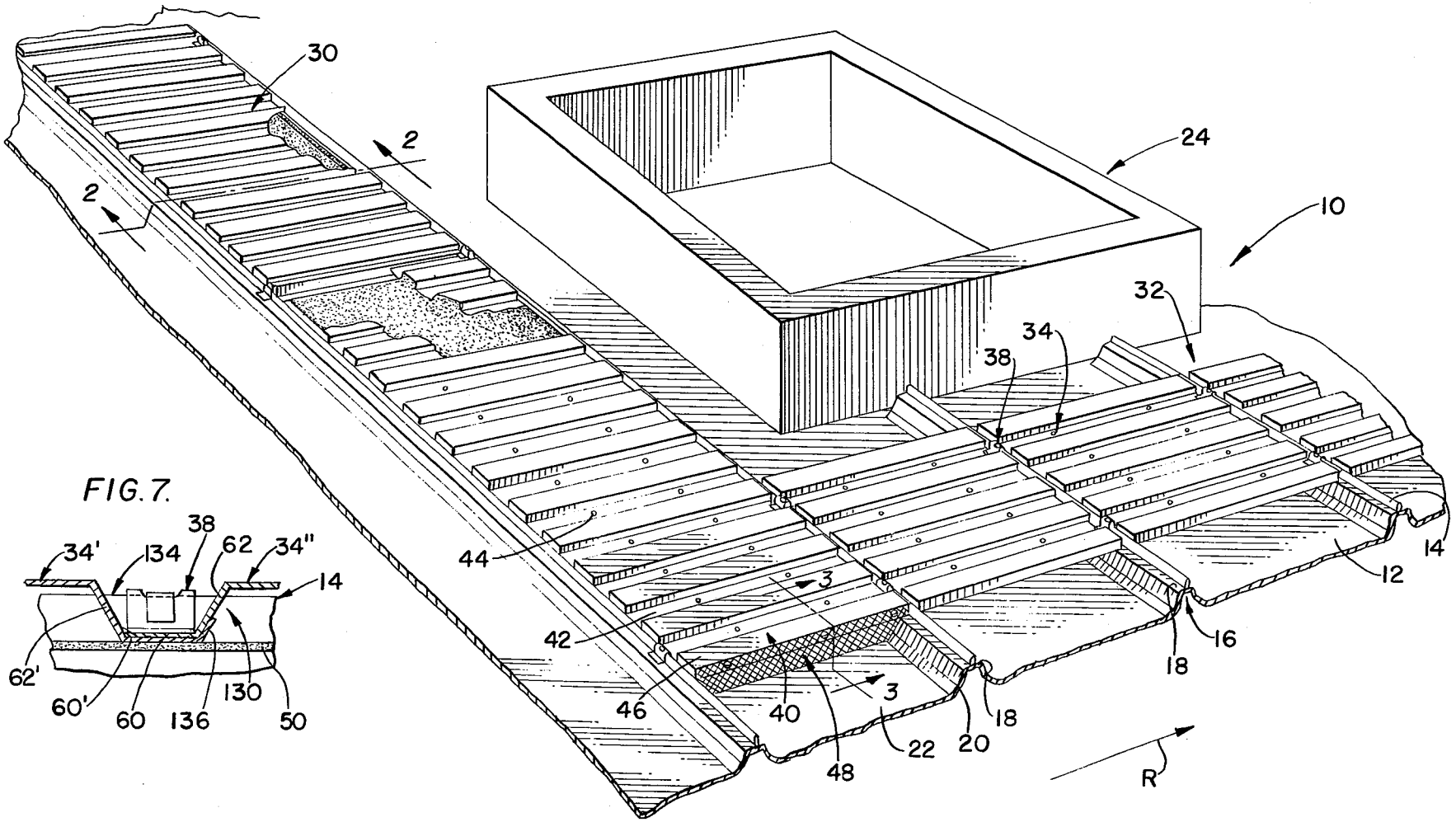
FIG. 1 is a perspective view of a roof section having maintenance platforms positioned thereon in accordance with the teachings of the present invention.
FIG. 7 is an elevation of a clip installed on a pair of overlapped maintenance platform panels in accordance with the teachings of the present invention.
Figure 2:
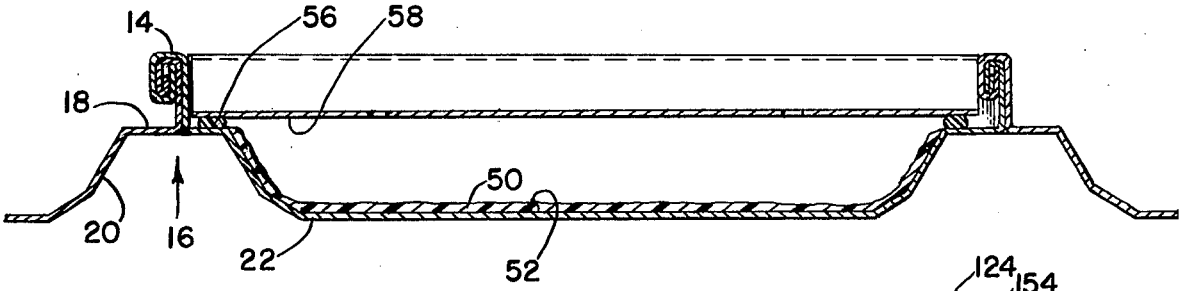
FIG. 2 is an elevation view of a section taken along line 2—2 of FIG. 1.

Shown in FIG. 1 is a building roof 10 comprising a plurality of roof panels 12. The panels 12 are interconnected by spaced apart standing seams 14 located on flat topped ribs 16 which form a ribbed surface for roof 10. The ribs of the joined roof panels each include a flat top 18 having depending therefrom inclined stepped skirts 20 which merge at the lower ends thereof into a roof panel trough 22. Also located on roof 10 is a mounting bed 24 for accommodating roof mounted air conditioning units, skylights, fans, hatches, head houses, or the like.

As discussed above, should it become necessary to service an element accommodated by the bed 24, extra roof loading associated with heavy loads, as well as personnel traffic, must be sustained by the roof. To support such extra loads, the roof embodying the present invention includes a transverse maintenance platform 30 and a longitudinal maintenance platform 32, with the longitudinal direction taken as the direction of the building ridge indicated by arrow R in FIG. 1. The maintenance platforms are preferably located adjacent bed 24, but can be positioned at other convenient locations on the roof. Furthermore, the maintenance platform panels can be arranged to form various configurations, such as, for example, straight paths, L-shapes, T-shapes, or cross-shapes. Each of the maintenance platforms is formed of a plurality of pre-formed corrugated maintenance platform panels 34, which are each seated on the flat tops 18 of the ribs and which are each mounted on the roof panels to span the troughs 22 in bridge-like fashion.

The maintenance platform panels are non-penetratingly fastened to the standing seams 14 by clip fasteners 38, and each has a plurality of flat topped ribs 40 and valleys or troughs 42 with drain holes 44 defined in the troughs 42 for draining water from the maintenance platform. The ribs have flat tops 46 which is coplanar with each other for providing a maintenance platform top surface. Wire mesh 48 is attached to the marginal edges of the maintenance platforms to depend into a roof panel trough to prevent debris from collecting in that trough under the maintenance platform and has a perimeter shaped to roughly correspond to the inner shape of the roof panel trough. Furthermore, the wire mesh 48 prevents birds from nesting beneath the maintenance platform. Thus, the mesh will have an outer shape approximating an isosceles trapezoid with the long parallel edge thereof connected to the maintenance platform and the short parallel edges thereof contacting the inner surface of the trough, and the non-parallel side legs contacting the inner stepped surfaces of the trough defined by the skirts 20. For the longitudinal maintenance platform 32, the mesh will be attached to the maintenance platform side edges, and for the transverse maintenance platform 30, the mesh will be attached to the maintenance platform end edges.

The maintenance platforms of the present invention thus support the roof loads attendant servicing and the like of the roof and/or equipment and elements mounted thereon.

As shown in FIGS. 2 and 4–6, a roof panel associated with a maintenance platform panel has thereon a layer of roof coating 50 on the trough upper surface 52, and a mastic material 56 located on flat tops 18 of the trough-bounding ribs 16. The paint 50 is on top of the surfaces of the roof panel and on the sides of the standing seam to the top thereof. The paint thus coats the entire panel, including the upstanding seam in the area where the maintenance platform is to be applied. The maintenance platform panels are seated on the mastic so that the undersurfaces 58 thereof are affixed by the mastic to flat tops 18. The roof coating, which is preferably aluminum asphalt asbestos, seals the roof, and the mastic eliminates noises and maintenance platform vibrations caused by wind, roof traffic and the like.

Figure 3:
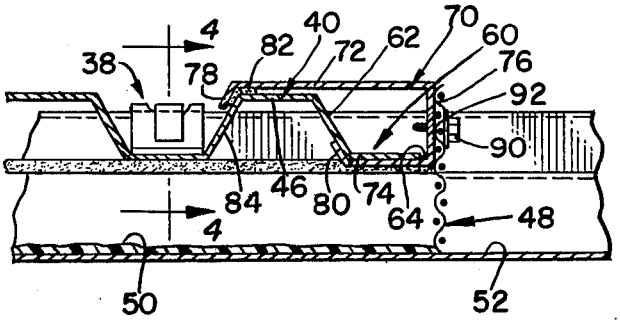
FIG. 3 is an elevation view of a section taken along line 3—3 of FIG. 1.

The mesh closure 48 is shown in FIG. 3. The mesh mounting outer edge of the maintenance platform panel is shown as having a flange 60 extending outwardly from a maintenance platform rib sloping skirt 62 so that the flange 60 corresponds to, and is coplanar with, a maintenance platform trough 42 and has a free end 64 projecting outwardly from the panel. An edge channel 70 is essentially U-shaped in cross-section and comprises a pair of legs 72 and 74 which are in spaced parallelism with respect to each other, with leg 74 being shorter than leg 72. The edge channel has a primary purpose of providing a strong, finished, flat surface at an exposed maintenance platform edge to support walking personnel. However, the edge channel also serves as a mounting fastener for mesh 48. The edge channel also provides protection to the outermost edges of the maintenance platform to prevent those edges from being bent or distorted. The legs are connected together by, and are integral with, a base 76 and have lips 78 and 80 integral with the free ends of legs 72 and 74, respectively. The lips 78 and 80 angle inwardly of the fastener to extend toward each other and form gripping jaws which are snugly engaged around the skirts of the rib to non-penetratingly attach the edge channel to the maintenance platform panel with base 76 in an upright orientation, as shown in FIG. 3. Because of its shape, the edge channel 70 does not require any additional fasteners to hold it to the maintenance platform. Mastic 82 is positioned between sloping skirt 84 of the rib 40 and the lip 78, as well as between leg 72 and rib top 46 of the rib 40 to secure the gripping jaw formed by lip 78 to the rib 40 in a non-slip, non-penetrating manner. The transverse dimension of the base 76 approximates the height dimension of the trapezoidal maintenance platform ribs, so that the edge channel can be oriented as shown in FIG. 3. A threaded fastener, such as a sheet metal screw 90, attaches the mesh 48 to the base 76 with a washer 92 interposed between the mesh and the fastener head. The mesh depends from the base and contacts inner surface 52 of the panel, and has sufficient stiffness to prevent debris from collecting in the trough beneath the maintenance platform.

Figure 5:
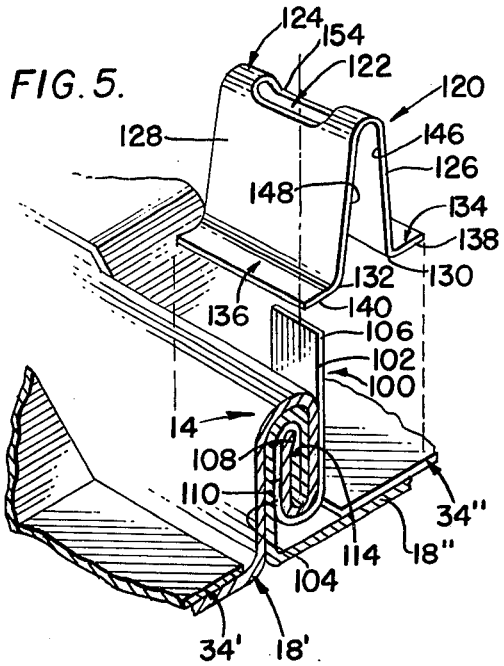
FIG. 5 is an exploded perspective of a clip embodying the teachings of the present invention.
Figure 4:
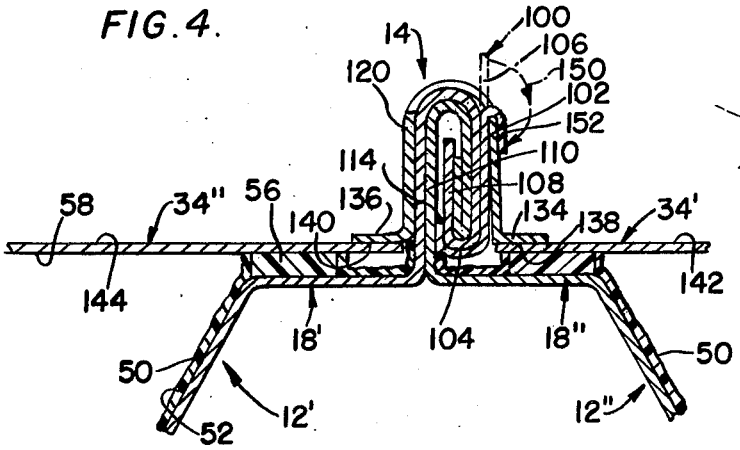
FIG. 4 is an elevation view of a roof panel seam with a clip hooked thereon in accordance with the teachings of the present invention.
Figure 6:
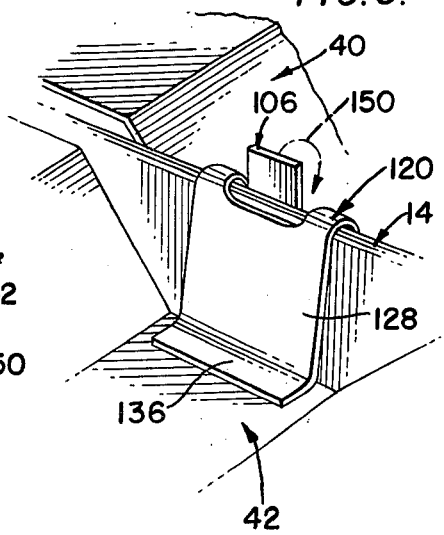
FIG. 6 is a perspective view of a clip installed on a roof seam according to the teachings of the present invention.

The panels are held on the ribs 40 against upward movement by the clips 38. A clip 38 is shown in FIGS. 4–6, and comprises a bendable hooking tab 100 having an elongate body 102 with a hooking cuff 104 at the lower end thereof. As shown in FIG. 4, the hooking cuff 104 is interfit into the standing seam 14 to be interlocked therein, with the body of the tab 100 held flatwise against the overlapping flange of seam 14. With the cuff 104 interlocked in the seam 14, a free end 106 of the tab extends upwardly and above the top of the seam, as shown in FIG. 5. The cuff 104 is received in the seam 14 and is trapped between overlapping edge 108 and upstanding edge 110 of adjacent roof panels 12' and 12'', and the terminal end 114 of the cuff extends into the seam far enough to assure a secure fit between the tab and the seam.

The clip 38 includes a resilient clasp 120 which is U-shaped in cross-section and has an elongate tab receiving aperture 122 defined in a bight portion 124 thereof to be longitudinally aligned with the clasp 120. Legs 126 and 128 are integral with the bight 124 and depend therefrom. The legs slightly diverge away from each other and terminate in free ends 130 and 132, each having thereon integral outwardly projecting panel engaging flanges 134 and 136, respectively, which are elongate with the longitudinal dimension thereof oriented to extend longitudinally of the clasp 120. As shown in FIG. 4, the panel engaging flanges have panel engaging surfaces 138 and 140, respectively, and the clasp is positioned to straddle the seam 14 so that the tab 100 passes upwardly through aperture 122 and the surfaces 138 and 140 are engaged against upper surfaces 142 and 144 of the side edges of adjacent maintenance platform panels 34' and 34''. The inner surfaces 146 and 148 of the legs 126 and 128, respectively, may, but need not, engage the outer surfaces of the seam.

As shown in FIG. 6, after the clasp is properly positioned on the maintenance platform panels, the projecting end 106 of the tab 100 is bent over as indicated by arrow 150 and crimped into an overlapping relationship against leg 126 of the clasp 120 to secure the clasp against upward movement. As shown in FIG. 4, the crimped tab 100 forms an S-shape and has a cuff 104 interlocked about the lower tip of over-lapping edge 108 of the standing seam, and top hook 152, formed by downturned projecting end 106, overlapping and locking with the top edge 154 of the aperture 122.

FIG. 4 shows maintenance platform panels on each side of a seam; however, only one panel need be used if so desired without altering the configuration of the clasp.

Preferably, the tab is formed of a malleable material and is elongate with the longitudinal dimension thereof oriented to be in the direction of the grain of the metal used to form that tab. The clasp is formed to have the longitudinal dimension thereof aligned with the longitudinal dimension of the tab receiving slot 122, which dimension is transverse of the grain of the material used to form the clasp. Likewise, the longitudinal dimension of the elongate unbent piece of metal used to form the edge channel 70 is transverse of the grain direction of that metal. Preferably, both the tab and the clasp, as well as the edge channel 70, are all manufactured of aluminum alloy, and the maintenance platform panels are formed of aluminum, preferably stucco-embossed aluminum.

FIG. 7 shows paired maintenance platform panels 34' and 34'' which are adjoined in an overlapping end-to-end disposition to form a continuous maintenance platform. The end 130 of panel 34'' corresponds to the maintenance platform panel end shown in FIG. 3, and has a flange 60 extending outwardly from a rib sloping skirt 62. End 134 of walkway panel 34' represents the other end of maintenance platform panel 34'', and vice versa. End 134 has a flange 60' extending outwardly from a sloping rib skirt 62', and has on a free end thereof an upturned lip 136. The flanges 60 and 60', and the skirts 62 and 62' are of the same dimension, so that the floors formed thereby are all essentially coplanar and the panels can be nested together as shown in FIG. 7. A clip 38 fastens the paired maintenance platform panels to the roof panels. While FIG. 7 shows the panels to be end-adjoined, because the panels are similarly shaped and dimensioned, it is possible to overlap the panels between the ends thereof. Thus, several of the ribs of each panel can be in overlapping relationship, so that the combined length of the two panels can be any suitable value, and the panels can even be layered one on top of the other in a co-extensive manner for stacking or storing the panels.

Having described the structure comprising the maintenance platform of the present invention, the method of installation will now be presented. Prior to installing a maintenance platform, roof coating 50 is applied to the appropriate surfaces of the roof panels. Once the roof coating 50 is applied, mastic 82 is applied to the flat tops of the ribs 40 which will support the maintenance platform panels. The mastic is applied to the ribs in the longitudinal direction of the seams 14 for a length equal to the length of the transverse maintenance platform, or equal to the width of the longitudinal maintenance platform.

With the roof panels thus properly prepared, the maintenance platform panels are next prepared, and the mounting fastener 70 is applied to the outer edge of selected maintenance platform panels. This outer edge will be the side edge of the longitudinal maintenance platforms, and the end edge of the transverse maintenance platforms. Of course, both edges of either maintenance platforms will be protected. The mesh is attached to the fastener 70 by field drilling that fastener and securing the mesh thereto using lock rivets, scrubolts, or the like. However, it is noted that mesh closures are not required for maintenance platforms having a width of a single panel. The purpose of the mesh is to prevent debris from accumulating beneath the maintenance platform, as it is difficult to remove such collected debris from beneath long, or wide, maintenance platforms. If the maintenance platform is but a single panel wide, removal of accumulated debris is a simple manner and hence, the wire mesh is not required.

The maintenance platform panels are then progressively applied to the prepared roof panels. Each walkway panel is pressed between the seams with the side edges of the maintenance platform panels seated by the mastic upon the flat tops of the ribs. Each maintenance platform panel is overlapped with the next adjoining maintenance platform panel, such as is shown in FIG. 7. Once the maintenance platform panels are properly oriented on the roof panels, the maintenance platform panels are pressed down onto the mastic to temporarily hold the panels in position until the clips are installed.

The clips are then installed. The tab 100 is centered between adjacent maintenance platform panel ribs, and the end 114 of hooking cuff 104 is forced into the seam 14. The tab is then pried upwardly, as by wedging a screwdriver blade between the tab and the maintenance platform panel, to secure that tab in the seam. The clasp is applied to the seam so that the projecting end 106 of the tab is received in slot 122, and forced onto the seam to seat the wings 134 and 136 onto the maintenance platform panel. Once the clasp is properly seated, the tab projecting end is crimped over against the clasp. Installation of the maintenance platform is completed by repeating the above-described process as many times as is necessary. The clips are installed at all panel laps and at the ends adjacent the edge channels 70 to secure the maintenance platform to the roof. However, only two clips are required to secure a maintenance platform panel to the roof, and it is again noted that the fastening of the maintenance platform panels to the roof does not require penetration of the roof panels.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A maintenance platform for use on a building roof formed of a plurality of roof panels interconnected by seams, the maintenance platform comprising:

a maintenance platform panel seated on one of the roof panels; and a clip securing said maintenance platform panel to a roof panel seam, said clip including an elongate tab having one end which is hooked into the seam and a U-shaped clasp having a pair of legs and a bight portion connecting said legs together, said clasp having defined therein a tab receiving slot, with the other end of said tab being received in said tab receiving slot to be hooked over one of said clasp legs to secure said clasp to the roof panel seam in a non-penetrating manner.

2. The maintenance platform of claim 1, wherein the roof panels are connected together to form ribs and troughs, with the seams each being located on a rib.

3. The maintenance platform of claim 1, wherein said clip further includes a wing on the free end of each leg which extends outwardly of said clasp.

4. The maintenance platform of claim 1, wherein said wings engage said maintenance platform panel.

5. The maintenance platform of claim 1, further including a debris catching means on one edge thereof, said debris catching means including an edge channel attached to said panel edge and a mesh screen attached to said edge channel to extend from said maintenance platform panel into engagement with the roof panel.

6. The maintenance platform of claim 5, wherein said edge channel is essentially U-shaped.

7. The maintenance platform of claim 1, further including mastic located between the roof panels and said maintenance platform panel.

8. The maintenance platform of claim 1, further including a liner on the roof panel between the roof panel and said maintenance platform panel.

9. The maintenance platform of claim 1, wherein the building has a ridge and further including a plurality of maintenance platform panels connected to form a maintenance platform which extends longitudinally of the building ridge direction.

10. The maintenance platform of claim 1, wherein the building has a ridge and further including a plurality of maintenance platform panels connected to form a maintenance platform which extends transversely of the building ridge direction.

11. The maintenance platform of claim 1, wherein said maintenance platform panel is aluminum.

12. The maintenance platform of claim 2, wherein said maintenance platform panel spans a trough of the roof panels.

13. The maintenance platform of claim 1, further including a plurality of maintenance platform panels, and wherein said maintenance platform panels are ribbed and similarly shaped to be nestable.

14. The maintenance platform of claim 14, wherein one edge of each maintenance platform panel has an upwardly angled lip thereon.

15. The maintenance platform of claim 1, wherein the seam includes a double lock seam.

16. The maintenance platform of claim 15, wherein said tab hook is engaged between the flanges of the seam.

17. The maintenance platform of claim 6, wherein said maintenance platform has a rib with a pair of sloping skirt sides connected together by a flat top, and one leg of said mesh fastener is longer than the other leg, and further including a pair of inwardly angled lips on the free ends of said legs for engaging said sloped skirts of said maintenance platform panel rib.

18. The maintenance platform of claim 17, further including mastic interposed between one leg of said edge channel and said maintenance platform panel.

* * * * *